US008556370B2

(12) United States Patent
McCready et al.

(10) Patent No.: US 8,556,370 B2
(45) Date of Patent: Oct. 15, 2013

(54) METHOD AND APPARATUS FOR REGISTERING AND MAINTAINING REGISTRATION OF A MEDIUM IN A CONTENT APPLICATOR

(75) Inventors: Kathy McCready, Bothell, WA (US); Kevin Conwell, Fairfield, OH (US); Xiaonong Qian, Mukilteo, WA (US)

(73) Assignee: Intermec IP Corp., Everett, WA (US)

( * ) Notice: Subject to any disclaimer, the term of this patent is extended or adjusted under 35 U.S.C. 154(b) by 347 days.

(21) Appl. No.: 13/082,235

(22) Filed: Apr. 7, 2011

(65) Prior Publication Data

US 2011/0181650 A1 Jul. 28, 2011

Related U.S. Application Data

(62) Division of application No. 11/738,334, filed on Apr. 20, 2007, now abandoned.

(51) Int. Cl.
*B41J 29/38* (2006.01)

(52) U.S. Cl.
USPC ..... 347/16

(58) Field of Classification Search
USPC ..... 347/14, 19, 16, 101, 3
See application file for complete search history.

(56) References Cited

U.S. PATENT DOCUMENTS

| | | | | |
|---|---|---|---|---|
| 2,741,176 | A | 4/1956 | Hollis | 101/227 |
| 3,553,041 | A | 1/1971 | von Hofe | 156/378 |
| 3,553,437 | A | 1/1971 | Boothroyd et al. | 235/61.11 |
| 4,188,252 | A | 2/1980 | Brown | 156/361 |
| 4,335,316 | A | 6/1982 | Glanz et al. | 250/572 |
| 4,349,741 | A | 9/1982 | Bobart et al. | 250/568 |
| 4,414,468 | A | 11/1983 | Laurer et al. | 235/462 |
| 4,662,971 | A | 5/1987 | Adams | 156/270 |
| 4,680,205 | A | 7/1987 | Lerner et al. | 428/29 |
| 4,735,664 | A | 4/1988 | Asghar et al. | 156/64 |
| 4,867,833 | A | 9/1989 | McCoy | 156/361 |
| 5,194,720 | A | 3/1993 | Reinnagel et al. | 235/437 |
| 5,232,540 | A | 8/1993 | Southwell et al. | 156/361 |
| 5,241,325 | A | 8/1993 | Nguyen | 346/1.1 |
| 5,272,322 | A | 12/1993 | Nishida et al. | 235/462 |
| 5,334,825 | A | 8/1994 | Maddox | 235/437 |
| 5,405,482 | A | 4/1995 | Morrissette et al. | 156/364 |
| 5,556,492 | A | 9/1996 | Vonderhorst et al. | 156/64 |

(Continued)

FOREIGN PATENT DOCUMENTS

JP 64-008066 1/1989

OTHER PUBLICATIONS

Armstrong et al., "Method for Analysis of Label Positioning and Printed Image to Identify and Correct Printing Anomalies," Preliminary Amendment filed Apr. 5, 2005, for U.S. Appl. No. 10/944,477, 16 pages.

(Continued)

*Primary Examiner* — Julian Huffman
(74) *Attorney, Agent, or Firm* — Seed IP Law Group PLLC

(57) ABSTRACT

A content applicator receives a continuous medium and applies content to segments of the continuous medium. The content applicator includes a sensor array, a controller subsystem, and a print station. The sensor array scans the continuous medium as the continuous medium moves along a medium transport pathway. The controller subsystem receives scan information from the sensor array and uses the scan information to establish and maintain registration between the continuous medium and the print station.

10 Claims, 10 Drawing Sheets

(56) References Cited

U.S. PATENT DOCUMENTS

| | | | | | |
|---|---|---|---|---|---|
| 5,564,841 | A | | 10/1996 | Austin et al. | 400/103 |
| 5,589,858 | A | * | 12/1996 | Kadowaki et al. | 347/14 |
| 5,591,952 | A | | 1/1997 | Krichever et al. | 235/462 |
| 5,619,416 | A | | 4/1997 | Kosarew | 364/478.13 |
| 5,708,462 | A | | 1/1998 | Helmbold et al. | 346/136 |
| 5,718,525 | A | | 2/1998 | Bruhnke et al. | 400/586 |
| 5,729,001 | A | | 3/1998 | Spitz | 235/462 |
| 5,781,708 | A | | 7/1998 | Austin et al. | 395/106 |
| 5,803,624 | A | | 9/1998 | Miazga et al. | 400/103 |
| 5,823,692 | A | | 10/1998 | Tolrud et al. | 400/582 |
| 5,823,693 | A | | 10/1998 | Henderson et al. | 400/611 |
| 5,848,341 | A | | 12/1998 | Watanabe | 399/352 |
| 5,861,078 | A | | 1/1999 | Huben et al. | 156/353 |
| 5,915,864 | A | | 6/1999 | Austin et al. | 400/708 |
| 5,915,865 | A | | 6/1999 | Wade | 400/709 |
| 5,922,169 | A | | 7/1999 | Chodacki et al. | 156/521 |
| 5,946,528 | A | | 8/1999 | Cho | 399/93 |
| 6,019,531 | A | | 2/2000 | Henderson et al. | 400/611 |
| 6,046,756 | A | * | 4/2000 | Iga et al. | 347/173 |
| 6,074,531 | A | | 6/2000 | Hultcrantz et al. | 162/263 |
| 6,084,681 | A | | 7/2000 | Keane | 356/430 |
| RE36,953 | E | | 11/2000 | Lodwig et al. | 400/234 |
| 6,161,914 | A | | 12/2000 | Haselby | 347/19 |
| 6,172,688 | B1 | | 1/2001 | Iwasaki et al. | 347/2 |
| 6,280,544 | B1 | | 8/2001 | Fox et al. | 156/64 |
| 6,298,778 | B1 | | 10/2001 | Onodera et al. | 101/232 |
| 6,358,353 | B1 | | 3/2002 | Maliner | 156/256 |
| 6,396,073 | B1 | | 5/2002 | Taylor | 250/559.42 |
| 6,535,299 | B1 | | 3/2003 | Scherz | 358/1.18 |
| 6,558,490 | B2 | | 5/2003 | Klein et al. | 156/64 |
| 6,561,427 | B2 | | 5/2003 | Davis et al. | 235/462.07 |
| 6,585,437 | B1 | | 7/2003 | Wiklof et al. | 400/621 |
| 6,633,740 | B2 | | 10/2003 | Estabrooks | 399/384 |
| 6,645,327 | B2 | | 11/2003 | Austin et al. | 156/64 |
| 6,682,163 | B2 | | 1/2004 | Metzler et al. | 347/19 |
| 6,801,236 | B2 | | 10/2004 | Araki et al. | 347/213 |
| 6,802,659 | B2 | | 10/2004 | Cremon et al. | 400/76 |
| 7,375,636 | B1 | | 5/2008 | Martin | 340/572.1 |
| 2002/0185536 | A1 | | 12/2002 | Tsunobuchi et al. | 235/454 |
| 2003/0035015 | A1 | * | 2/2003 | Conwell et al. | 347/8 |
| 2003/0081229 | A1 | | 5/2003 | Underwood et al. | 358/1.9 |
| 2003/0146968 | A1 | | 8/2003 | Milton | 347/197 |
| 2003/0174187 | A1 | | 9/2003 | Greive | 347/43 |
| 2004/0056913 | A1 | | 3/2004 | Kniazzeh et al. | 347/19 |
| 2004/0056951 | A1 | | 3/2004 | Anderson et al. | 348/96 |
| 2004/0130458 | A1 | | 7/2004 | Koutsoukos et al. | 340/870.01 |
| 2004/0196324 | A1 | | 10/2004 | Tschida | 347/19 |
| 2005/0160935 | A1 | | 7/2005 | Armstrong et al. | 101/485 |
| 2006/0055721 | A1 | | 3/2006 | Burdette et al. | 347/19 |
| 2006/0150853 | A1 | | 7/2006 | Patrik | 101/485 |
| 2006/0269332 | A1 | | 11/2006 | Yamanaka et al. | 399/323 |
| 2006/0289106 | A1 | | 12/2006 | Thiel et al. | 156/64 |
| 2007/0062636 | A1 | | 3/2007 | Gustafsson et al. | 156/244.16 |

OTHER PUBLICATIONS

Armstrong et al., "Method for Analysis of Label Positioning and Printed Image to Identify and Correct Printing Anomalies," Office Action mailed Dec. 2, 2005, for U.S. Appl. No. 10/944,477, 10 pages.
Armstrong et al., "Method for Analysis of Label Positioning and Printed Image to Identify and Correct Printing Anomalies," Amendment filed Mar. 31, 2006, for U.S. Appl. No. 10/944,477, 11 pages.
Armstrong et al., "Method for Analysis of Label Positioning and Printed Image to Identify and Correct Printing Anomalies," Office Action mailed Jun. 2, 2006, for U.S. Appl. No. 10/944,477, 11 pages.
Armstrong et al., "Method for Analysis of Label Positioning and Printed Image to Identify and Correct Printing Anomalies," Amendment filed Oct. 2, 2006, for U.S. Appl. No. 10/944,477, 34 pages.
Armstrong et al., "Method for Analysis of Label Positioning and Printed Image to Identify and Correct Printing Anomalies," Office Action mailed Nov. 13, 2006, for U.S. Appl. No. 10/944,477, 9 pages.
Armstrong et al., "Method for Analysis of Label Positioning and Printed Image to Identify and Correct Printing Anomalies," Amendment filed Feb. 13, 2007, for U.S. Appl. No. 10/944,477, 17 pages.
Armstrong et al., "Method for Analysis of Label Positioning and Printed Image to Identify and Correct Printing Anomalies," Office Action mailed Dec. 17, 2007, for U.S. Appl. No. 10/944,477, 13 pages.
Armstrong et al., "Method for Analysis of Label Positioning and Printed Image to Identify and Correct Printing Anomalies," Amendment filed Apr. 17, 2008, for U.S. Appl. No. 10/944,477, 18 pages.
Armstrong et al., "Method for Analysis of Label Positioning and Printed Image to Identify and Correct Printing Anomalies," Office Action mailed Feb. 6, 2009, for U.S. Appl. No. 10/944,477, 13 pages.
Gustafsson et al., "Media Gap Detection by Reflective Florescence," Office Action mailed Apr. 4, 2008, for U.S. Appl. No. 11/365,479, 5 pages.
Gustafsson et al., "Media Gap Detection by Reflective Florescence," Office Action mailed Apr. 28, 2009, for U.S. Appl. No. 11/589,327, 9 pages.
McCready et al., "Method and Apparatus for Registering and Maintaining Registration of a Medium in a Content Applicator," Office Action mailed May 17, 2010, for U.S. Appl. No. 11/738,334, 14 pages.
McCready et al., "Method and Apparatus for Registering and Maintaining Registration of a Medium in a Content Applicator," Amendment filed Nov. 16, 2010, for U.S. Appl. No. 11/738,334, 15 pages.
McCready et al., "Method and Apparatus for Registering and Maintaining Registration of a Medium in a Content Applicator," Office Action mailed Jan. 7, 2011, for U.S. Appl. No. 11/738,334, 10 pages.

* cited by examiner

RFID
118
116
RFID
118
116
36
34
32
88
118
116
32
36
34
120
130
124
122
128
126
132
130
124
122
128
126
132
120
130
124
122
128
126

METHOD AND APPARATUS FOR REGISTERING AND MAINTAINING REGISTRATION OF A MEDIUM IN A CONTENT APPLICATOR

CROSS-REFERENCE TO RELATED APPLICATIONS

This application is a division of co-pending U.S. patent application Ser. No. 11/738,334, filed Apr. 20, 2007, which is incorporated herein, by reference, in its entirety.

BACKGROUND

1. Field

This disclosure is generally related to the field of printers, and more particularly related to registration of continuous medium in a printer.

2. Description of the Related Art

Today, on-demand printing frequently involves an on-demand printer printing specific information or content on a print medium, such as a label, and may involve applying the printed medium to an item. In some situations, the item might be one item in a series of items such as an item in an assembly line. In that case, the on-demand printer and the assembly line may be synchronized such that the printed medium can be applied to the item as the item passes the on-demand printer. The print medium used in an on-demand printer may be a continuous medium such as a roll of labels carried on a releasable liner. The printed labels may be peeled from the releasable liner and adhered to items. However, if the continuous medium, such as a label roll, is not properly registered with the on-demand printer, then content printed on the labels of the continuous medium may be misaligned or some or all of the content that should have been printed on a label might not be printed on the label, e.g., the printed content might extend across labels.

In addition, there are many varieties of print media including many types of continuous print media. For example, label rolls may come in different sizes, or they may come with different face stock, or they come with a wireless communication device such as Radio Frequency Identifier (RFID) device. Typically, an on-demand printer is manually configured to use one variety of continuous medium and then reconfigured to use another variety of continuous medium. For example, the on-demand printer might be configured to use one type of marker such as ink, ribbon, or the like on a first face stock and a different type of maker on a second face stock.

There is a need for a printer that may sense a print medium and automatically reconfigure internal settings. In addition, there exists a need for a printer that may properly register a continuous medium, and similarly, there exists a need for a printer that may maintain proper registration of a continuous medium.

BRIEF SUMMARY

In one aspect, a content applicator for applying content to a continuous medium comprises a print station, an array of electromagnetic sensors, and a controller subsystem. The print station has a print head disposed proximal to a medium transport pathway. The continuous medium passes through the medium transport pathway, and the print head is configured to print on the continuous medium. The array of electromagnetic sensors is disposed proximal to the medium transport pathway and is configured to scan a portion of the continuous medium. The controller subsystem is in communication with the electromagnetic sensors and is configured to determine a speed for the scanned portion of the continuous medium, wherein the controller subsystem adjusts the speed of the continuous medium to maintain registration of the continuous medium with the print station.

In another aspect, a method of controlling a content applicator includes receiving a first set of scan information from a scan of a portion of a label in a continuous medium received by the content applicator, the continuous medium having a number of labels; determining a scan location by comparing the first set of scan information to a reference scan profile, the reference scan profile corresponding to a scan of a given label; and changing a rate at which the continuous medium moves through a print station of the content applicator based upon the determined scan location.

In another aspect, a content applicator for applying content to a continuous medium comprises a print station, an array of electromagnetic sensors, and a controller subsystem. The print station has a print head disposed proximal to a medium transport pathway. The continuous medium passes through the medium transport pathway, and the print head is configured to print on the continuous medium. The array of electromagnetic sensors is disposed proximal to the medium transport pathway and is configured to scan a portion of the continuous medium. The controller subsystem is in communication with the electromagnetic sensors and is configured to determine at least a portion of a first profile for a label included in the scanned portion of the continuous medium and to use at least the portion of the profile to maintain registration of the continuous medium with the print station.

BRIEF DESCRIPTION OF THE SEVERAL VIEWS OF THE DRAWING(S)

In the drawings, identical reference numbers identify similar elements or acts. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

DETAILED DESCRIPTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with systems and methods for handling media, printing, and forming and/or applying labels and the like have not been shown or described in detail to avoid unnecessarily obscuring descriptions of the embodiments.

Unless the context requires otherwise, throughout the specification and claims which follow, the word "comprise" and variations thereof, such as "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the terms "and" and "or" are generally employed in the sense including "and/or" unless the content clearly dictates otherwise.

The headings and Abstract of the Disclosure provided herein are for convenience only and do not interpret the scope or meaning of the embodiments.

Figure 1:
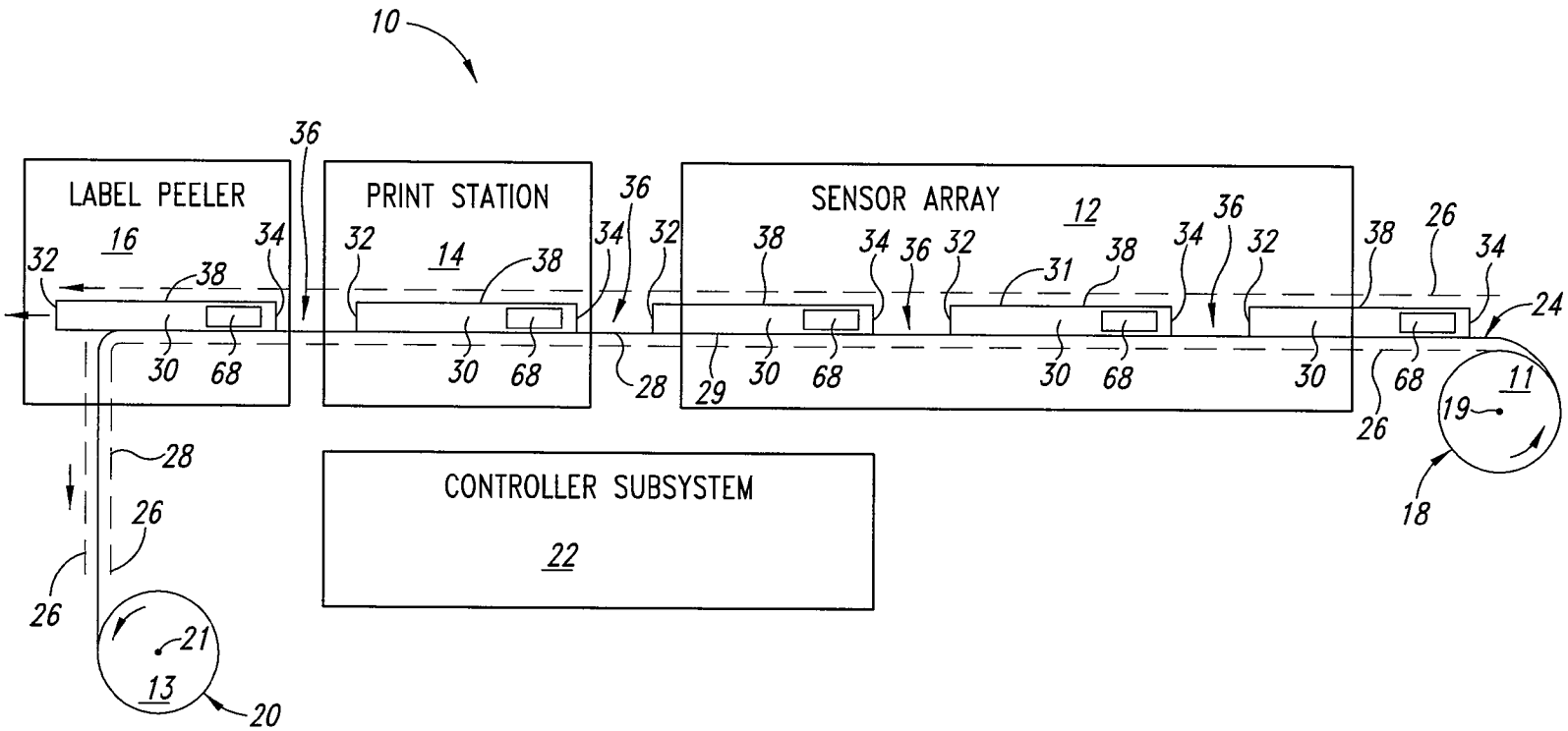
FIG. 1 is a block diagram of a content applicator according to one illustrated embodiment.

FIG. 1 shows a content applicator 10 according to one illustrated embodiment. In some embodiments, the content applicator 10 may include a printing device such as, but not limited to, an ink jet printer, a dot matrix printer, an impact printer, a laser printer, and/or a thermal printer.

The content applicator 10 includes a sensor array 12, a print station 14, a label peeler 16, a medium dispenser 18, and a medium take-up 20, all of which may be controlled by a controller subsystem 22. A continuous medium 24 is dispensed from the medium dispenser 18 and extends along a medium transport pathway 26 to the medium take-up 20.

The medium dispenser 18 may include a roll 11 of the continuous medium 24 mounted on a spindle 19. The spindle 19 may be driven to cause the roll 11 to rotate clockwise and/or counter-clockwise and thereby wind and unwind the continuous medium 24. Similarly, the medium take-up 20 may include a roll 13 mounted on a spindle 21, and the spindle 19 may be driven to cause the roll 13 to rotate counter-clockwise and/or clockwise and thereby wind and unwind the continuous medium 24.

The continuous medium 24 defines a bottom face 29 and an opposed top face 31. A number of labels 30 form at least a portion of the top face, and a release liner 28 forms at least a portion of the bottom face 29. The labels 30 are releasably adhered to the release liner by an adhesive layer (not shown), for example, a pressure sensitive adhesive layer.

Each one of the labels 30 extends between opposed leading edge 32 and trailing edge 34 of the respective label 30. In the embodiment illustrated, the labels 30 do not abut. Instead, the labels 30 are disposed on the release liner 28 such that there is a gap 36 between adjacent labels 30. The labels 30 and the portions of the release liner 28 that are exposed in gap regions 36 define at least a portion of the top face 31 of the continuous medium 24. Each one of the labels 30 includes a print region 38 on which the print station 14 applies indicia.

The sensor array 12 scans the continuous medium 24 as the continuous medium 24 passes along the medium transport pathway 26. In some embodiments, the sensor array 12 may be disposed along the medium transport pathway 26 between the print station 14 and the label peeler 16. The sensor array 12 provides the controller subsystem 22 with medium scan information.

The label peeler 16 removes the labels 30 from the release liner 28, and applies the labels 30 to target objects (not shown). In some embodiments, the label peeler 16 may take the form of a simple bar 17 or structure having an edge that engages the labels 30 at an acute angle. Other embodiments may employ a variety of more complicated structures to peel or otherwise remove or separate the labels 30 from the release liner 28. The release liner 28 extends from the label peeler 16 to the medium take-up 20. In some embodiments, the label peeler 16 may be bypassed or configured such that the labels 30 are not removed from the release liner 28, and in that case, the release liner 28 and labels 30 are received by the take-up 20.

The controller subsystem 22 receives medium scan information from the sensor array 22 and uses the medium scan information to manage advancement (position) and/or the rate of advancement (speed) of the continuous medium 24. The continuous medium 24 must be properly registered with the print station 14 and the label peeler 16 to ensure that the indicia is properly applied to the print region 38 of each one of the labels 30 and to ensure that each one of the labels 30 is properly applied to the target objects (not shown) by the label peeler 16.

Figure 2:
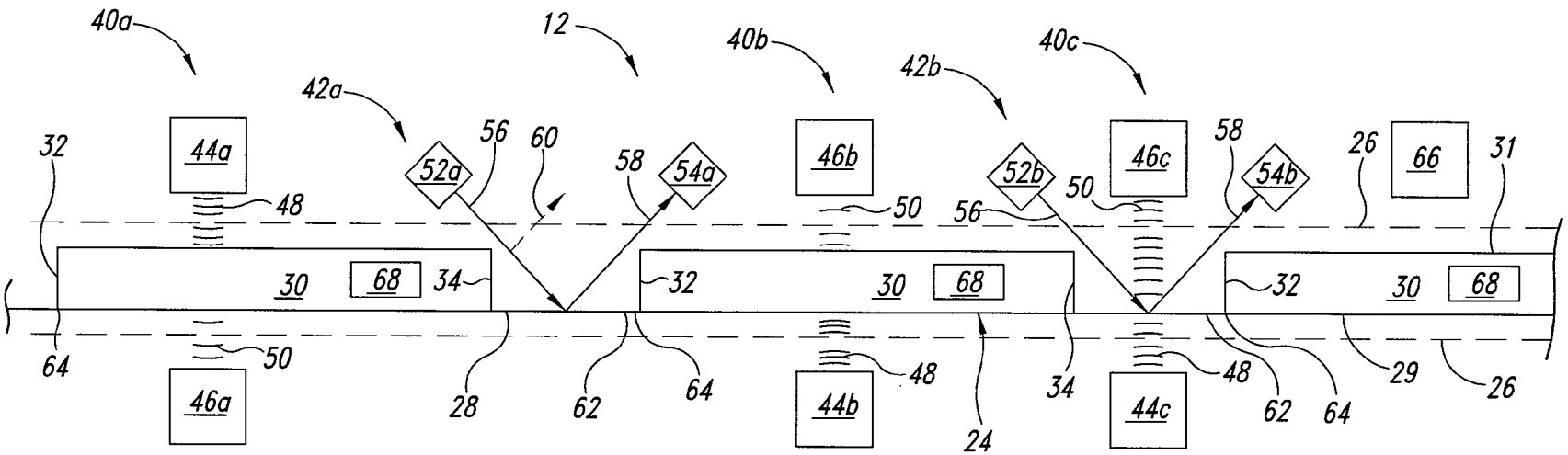
FIG. 2 is a block diagram of a sensor array of the content applicator of FIG. 1 according to one illustrated embodiment.

FIG. 2 shows components of the sensor array 12 according to one illustrated embodiment. The sensor array 12 includes a number of opposed sensor bundles, which are collectively referenced as 40 and individually referenced as 40*a*-40*c*, and a number of non-opposed sensor bundles, which are collectively referenced as 42 and individually referenced as 42*a*-42*b*.

The opposed sensor bundles 40 include a number of electromagnetic sources, collectively referenced as 44 and individually referenced as 44*a*-44*c*, and a corresponding number of electromagnetic detectors, collectively referenced as 46 and individually referenced as 46*a*-46*c*. A given opposed sensor bundle 40X includes an electromagnetic source 44X and an electromagnetic detector 46X, where X is a, b, or c. The opposed sensor bundles are named as such because for each bundle, the respective electromagnetic source 44 and the respective electromagnetic detector 46 are disposed on opposite sides of the medium transport pathway 26 and generally aligned with each other. The electromagnetic sources 44 emit electromagnetic radiation 48, which is incident on the continuous medium 24. The electromagnetic detectors 46 receive electromagnetic radiation 50 from the continuous medium 24.

The non-opposed sensor bundles 42 include a number of electromagnetic sources, collectively referenced as 52 and individually referenced as 52*a*-52*b* and a corresponding number of electromagnetic detectors, collectively referenced as 54 and individually referenced as 54*a*-54*b*. A given non-opposed sensor bundle 42X includes an electromagnetic source 52X and an electromagnetic detector 54X, where X is a or b. The non-opposed sensor bundles are named as such because for each bundle, the respective electromagnetic source 52 and the respective electromagnetic detector 54 are disposed on the same side of the medium transport pathway 26. The electromagnetic sources 52 emit electromagnetic radiation 56, which is incident on the continuous medium 24, and the electromagnetic detectors 54 are arranged to receive electromagnetic radiation 58 from the continuous medium 24. In some embodiments, one or more of the sensors bundles 42 may be arranged such that the electromagnetic source 52 and the corresponding electromagnetic detector 54 are longitudinally aligned and transversely offset with respect to the medium transport pathway 26.

In some embodiments, the electromagnetic sources 44 and 52 may include sources such as light emitting diodes, lasers, and/or other electromagnetic sources including non-coherent sources and non-monochromatic sources. In some embodiments, the electromagnetic sources 44, 52 may emit electromagnetic radiation over various portions of the electromagnetic spectrum. As a non-limiting example, one or more of the electromagnetic sources 44 may emit light in the infrared portion of the electromagnetic spectrum, and one or more of the electromagnetic sources 52 may emit light in the ultraviolet portion of the electromagnetic spectrum and/or visible light. In other words, the electromagnetic sources can be individually selected to emit a given wavelength of electromagnetic radiation such that all of the electromagnetic sources emit the same wavelength of electromagnetic radiation, or all of the electromagnetic sources emit different wavelengths of electromagnetic radiation, or such that some of the electromagnetic sources emit the same wavelength of electromagnetic radiation and the other electromagnetic sources emit different wavelengths of electromagnetic radiation, and/or any combination or permutation thereof.

The electromagnetic detectors 46, 54 may include detectors such as light sensitive diodes and charge-coupled devices (CODs), among others. In some embodiments, an array of detectors such as multiple photodiodes or a CCD array may be associated with one of the electromagnetic sources 52. The array of detectors may be used to track the leading edge 32 and/or trailing edge 34 of the labels 30.

In some embodiments, one or more of the electromagnetic detectors may detect electromagnetic radiation at a wavelength that is generally the same as the wavelength of the electromagnetic radiation emitted from the corresponding electromagnetic source. In other words, for a given sensor bundle, such as 42*a*, the electromagnetic source 52*a* and the electromagnetic detector 54*a* may operate over the same general wavelength band. Alternatively, one or more of the electromagnetic detectors may detect electromagnetic radiation different from the electromagnetic radiation emitted the corresponding electromagnetic source. In other words, for a given sensor bundle, such as 42*b*, the electromagnetic source 52*b* and the electromagnetic detector 54*b* may operate over the different wavelength bands, e.g., the electromagnetic radiation emitted from the electromagnetic source 52*b* may cause portions of the continuous medium 24 to fluoresce at a wavelength different from the emitted electromagnetic radiation and the electromagnetic source 52*b* may detect the fluorescence of the continuous medium 24. Each one of the electromagnetic detectors 46, 54 is configured to provide an analog output signal, which corresponds to detected electromagnetic radiation, to the controller subsystem 22.

The electromagnetic radiation 50 and 58 from the continuous medium 24 may include ambient electromagnetic radiation reflected from the continuous medium 24, and/or the electromagnetic radiation 50 and 58 from the continuous medium 24 may be electromagnetic radiation due to fluorescence of the continuous medium 24. In addition, the electromagnetic radiation 58 from the continuous medium 24 may include incident electromagnetic radiation 56 that is reflected from the continuous medium 24.

In some embodiments, the sensor array 12 may include fewer or more opposed sensor bundles 44, and/or fewer or more non-opposed sensor bundles 42. In some embodiments, the sensor array may include one or more non-opposed sensor bundles 44 disposed under the medium transport pathway 26 such that the bottom face 31 of the continuous medium 24 is exposed to the sensor bundles 42 underneath the medium transport pathway 26.

The non-opposed sensor bundles 40 may be used to detect a change in height of the continuous medium 24. The dashed line 60 represents an electromagnetic array reflected from one of the labels 30. When electromagnetic radiation 56 from the electromagnetic source 52*a* is incident upon the release liner 28 in the gap 36, the electromagnetic detector 54*a* receives the reflected electromagnetic radiation 58. However, when the electromagnetic radiation 56 from the electromagnetic source 52*a* is incident upon a portion of the label 30, the electromagnetic radiation is reflected along the path 60 and is not received by the electromagnetic detector 54*a*. Thus, the path difference for electromagnetic radiation reflected from the gap 36 or from the label 30 can be used to find the gap 36.

In some embodiments, the opposed sensor bundles 40 may be used to determine the location of the leading edge 32 and/or the location of the trailing edge 34. In some embodiments, a change in intensity and/or frequency of the detected electromagnetic radiation 50 may be used to determine the location of the leading edge 32 and/or the trailing edge 34 of the labels 30. For example, the intensity and/or frequency of detected electromagnetic radiation 50 may depend upon whether the incident electromagnetic radiation 48 was transmitted through the release liner 28 and the gap 36 or whether the incident electromagnetic radiation 48 was transmitted through the release liner 28 and one of the labels 30. In some embodiments, either the release liner 28 or the label 30 may fluoresce in response to electromagnetic radiation 48 and/or 50 being incident upon the continuous medium 24. If the release liner 28 fluoresces, then the fluorescence of the release liner 28 at a different frequency and/or intensity can be used to track the gap 36. On the other hand, if the labels 30 fluoresce, then the fluorescence of the labels 30 can be used to track the leading edge 32 and/or trailing edge 34 of the labels 30.

In some embodiments, holes 62 may be formed in the release liner 28 in proximity to, or abutting, the leading edge 32 and/or the trailing edge 34 of the labels 30. The intensity of the detected electromagnetic radiation 50 will increase when the electromagnetic radiation 48 is incident upon one of the holes 62. Consequently, the change in intensity of detected electromagnetic radiation 50 can be used to track the leading edge 32 and/or the trailing edge 34 of the labels 30.

In some embodiments, the release liner 28 may carry transition indicia 64, which may be on the top face 31 of the continuous medium 24 and/or on the bottom face 29 of the continuous medium 24. If the transition indicia 64 is on the top face 31, the transition indicia 64 may be abutting the leading edges 32 and/or the trailing edges 34 of the labels 30. Alternatively, the transition indicia 64 may be at a predetermined location relative to either the leading edge 32 and/or the trailing edge 34. On the other hand, if the transition indicia 64 is on the bottom face 29 of the continuous medium 24, the transition indicia 64 may be underneath the leading edge 32 and/or trailing edge 34 of the labels 30 and/or at a predetermined location relative to either the leading edge 32 and/or the trailing edge 34. A non-opposed sensor bundle 42 having an electromagnetic source 52 and an electromagnetic detector 54 may be used to detect the transition indicia 64.

Similarly, a non-opposed sensor bundle 42 that is arranged such that the electromagnetic source 52 and the electromagnetic detector 54 are longitudinally aligned and transversely offset can be used to detect the holes 62. In such a configured non-opposed sensor bundle, the electromagnetic source 52 and the electromagnetic detector 54 can be arranged such that incident electromagnetic radiation 58 is reflected from the continuous medium 24 as electromagnetic radiation 56. When the incident electromagnetic radiation 56 is incident upon one of the holes 62, the intensity of the detected electromagnetic radiation 56 decreases, which allows the non-opposed sensor bundle 42 to detect the holes 62.

In some embodiments, the array sensor 12 includes a wireless communication device interface 66, which is in communication with the controller subsystem 22. The wireless communication device interface 66 may be used to sense wireless communication devices 68. Wireless communication devices 68 may be disposed on or in the labels 30. In addition, the wireless communication device interface 66 may be used to read/write/interrogate wireless communication devices 68. As a non-limiting example, the wireless communication device interface 66 may include a radio frequency identification (RFID) reader/writer or interrogator, and wireless communication devices 68 may include RFID devices or transponders, for example, RFID tags. Among other things, information gathered by the wireless communication device interface 66 is provided to the controller subsystem 22. The controller subsystem 22 may also provide information to the wireless communication device interface 66, and some or all of the information from the controller subsystem 22 may be provided by the wireless communication device interface 66 to one or more wireless communication devices 68. Typically, the wireless communication device interface 66 is arranged proximal to the medium transport pathway 26 such that the wireless communication device interface 66 senses the presence of wireless communication devices 68 as the labels 30 travel along the medium transport pathway 26.

In some embodiments, the wireless communication device interface 66 provides a signal to the controller subsystem 22 when the wireless communication device interface 66 senses a wireless communication device 68. Thus, the wireless communication device interface 66 can be used to detect the presence of wireless communication devices 68 and to track labels 30 as the labels 30 move along the medium transport pathway 26.

Figure 3:
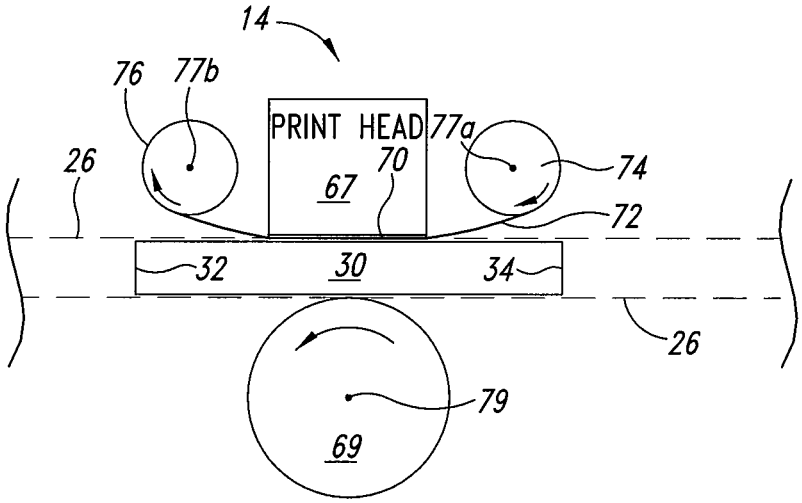
FIG. 3 is a block diagram of print station of the content applicator of FIG. 1 according to one illustrated embodiment.

FIG. 3 shows the print station 14 according to one illustrated embodiment. The print station 14 includes a print head 67 and a platen roller 69. The print head 67 and the platen roller 69 are arranged on opposite sides of the medium transport pathway 26. The print head 67 has a print side 70 proximal to the medium transport pathway 26.

A ribbon 72, such as a thermal transfer ribbon, passes underneath the print side 70 and extends from a let-out roll 74 to a take-up roll 76. The let-out roll 74 and the take-up roll 76 are mounted on spindles 77*a* and 77*b*, respectively, which may be driven. The print side 70 of the print head 67 presses the ribbon 72 against the label 30 so that print indicia may be printed in the print region 38 of the labels 30. The ribbon 72 is unwound from the let-out spindle 74 and rewound on the take-up spindle 76. Among other things, tension in the ribbon 72 may be controlled by the controller subsystem 22 via the driven spindles 77*a* and 77*b*. The controller subsystem 22 may control tension by increasing or decreasing torque in one or both of the let-out spindle 74 and/or take-up spindle 76. The controller subsystem 22 may also control the rate at which the ribbon 72 is unwound from the let-out spindle 74 and/or the rate at which the ribbon 72 is wound on the take-up spindle 76.

The platen roller 69 rotates about an axis 79. Pressure between the print head 67 and the platen roller 69 causes the rotation of the platen roller 69 to advance the continuous medium 24 through the print station 14. The controller subsystem 22 may control the pressure between the print head 67 and the platen roller 69 and/or the rate of rotation of the platen roller 69. In some embodiments, the platen roller 69 may rotate in discrete steps, and the steps may be variable in size. The controller subsystem 22 may control the rate of stepping and/or the size of each step, i.e., the amount of rotation. In some embodiments, the platen roller 69 may rotate continuously at a variable rate. Some embodiments may apply other types of mechanisms to form indicia, for example, different types of print heads, which may or may not include a platen, which may or may not be fixed.

Figure 4:
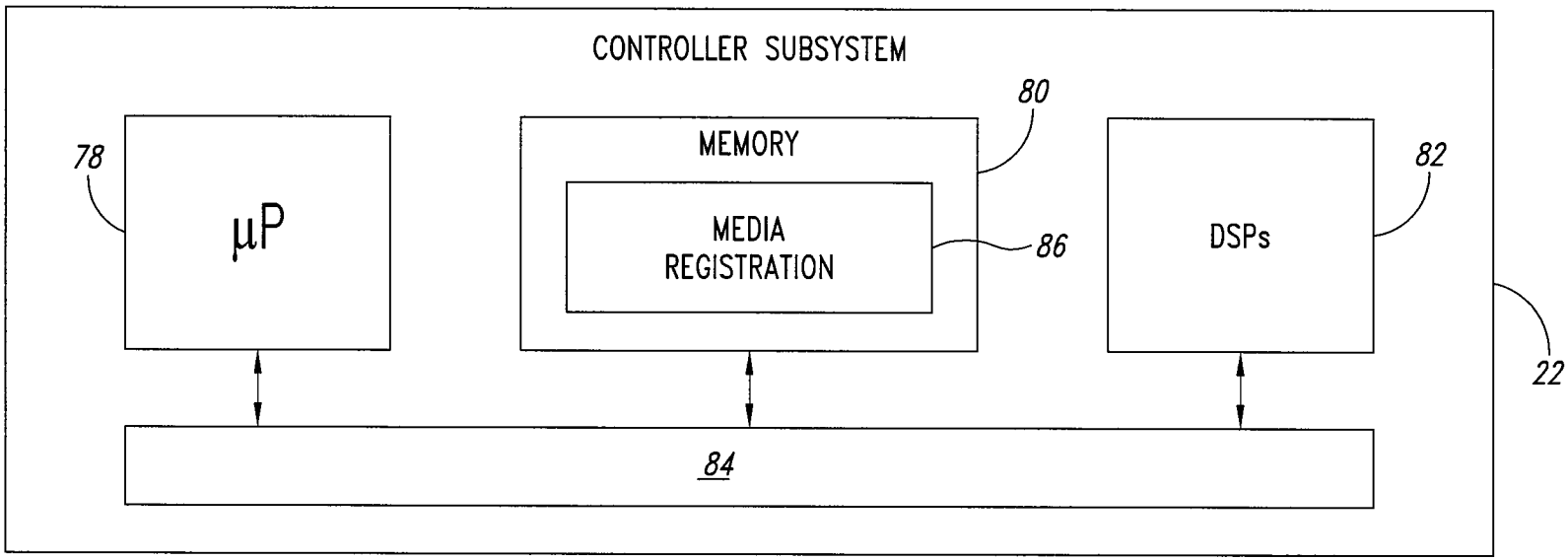
FIG. 4 is a block diagram of a controller subsystem of the content applicator of FIG. 1 according to one illustrated embodiment.

FIG. 4 shows the controller subsystem 22 according to one illustrated embodiment. The controller subsystem 22 includes a processor 78, a memory 80, one or more digital signal processors (DSPs) 82, and a bus, which connects all of the above. The DSPs 82 receive the analog signals from the sensor array 14 and provide digital output, which corresponds to the received analog signals, to the processor 78.

Among other things, the controller subsystem 22 may maintain proper registration of the continuous medium 24 by, among other things, adjusting the rate at which the continuous medium 24 passes through the content applicator 10. The controller subsystem 22 may determine a medium advancement rate, i.e., the current rate at which the continuous medium 24 passes through the content applicator 10, and compare the current medium advancement rate to a theoretical or desired rate, and if necessary, the controller subsystem 22 can make adjustments to the medium advancement rate to cause the continuous medium 24 to advance faster or slower or to retract. By controlling the medium advancement rate to reasonably match the theoretical or desired rate, content applied to the labels 30 by the print head 67 is correctly positioned and scaled.

In some embodiments, each sensor bundle 40*a*-40*c* or 42-42*b* may be capable of detecting the leading edge 32 or trailing edge 34 on a single label 30. Thus, within the sensor array 12, the same leading edge 32 or trailing edge 34 on the label 30 may be detected at multiple scan positions, which are known by the controller subsystem 22. The controller subsystem 22 may determine the current position of a label whenever the leading edge 32 or trailing edge 34 of the label is detected by one of the sensor bundles 40, 42. The resolution in the current position of the label may be limited by how close adjacent sensors bundles 40,42 may be physically placed and/or by a separation distance between adjacent scan positions and/or how fast the controller subsystem 22 is able to process the information from the sensor array 12. By adopting multiple sensor bundles 40, 42 in the sensor array 12, a variation in the medium advancement rate can be detected in higher resolution in the sense of medium movement length. Whereas, if only one sensor bundle is used to detect the leading edge 32 and the trailing edge 34 of the same label 30, or to detect the leading edges 32 of adjacent labels 30, then the resolution is limited by the label length.

The memory 80 includes a medium registration logic 86. When the medium registration logic 86 is executed by the processor 78, the processor 78 can control the advancement and/or the rate of advancement of the continuous medium 24 in the content applicator 10. In addition, the processor 78 may control the retraction and/or the rate of retraction of the continuous medium 24. Among other things, the processor 78 may control the advancement and/or retraction of the continuous medium by one or more of the following: varying the step size of the platen roller 69; varying the rate at which the platen roller 69 rotates or steps; varying the direction of rotation of the platen roller 69; varying the tension in the ribbon 72; varying the pressure between the platen roller 69 and the print head 67; varying the rate at which the medium take-up 20 winds the release liner 28; varying the rate at which the medium dispenser 18 unwinds the continuous medium 24; varying the torque about the driven spindle 21 of the medium take-up 20; varying the torque about the driven spindle 19 of the medium dispenser 18; and varying the tension in the continuous medium 24. The processor 78 may control such by applying appropriate drive signals to one or more actuators, for example, one or more motors, for instance one or more stepper motors coupled to drive the platen roller 69, spindle 77*b* and/or spindle 21, or other drive mechanism.

In some embodiments, the sensor array 14 may be distributed in the content applicator 10. For example, the one or more sensor bundles may be disposed along the medium transport pathway 26 before and after the print station 14. For each one of the sensor bundles, the processor 78 can then calculate the speed or velocity of the continuous medium 24 at each respective sensor bundle. If the calculated velocities of the continuous medium 24 are different or the differences exceed a threshold, then the continuous medium 24 may be slipping, which may be caused by, among other things, excessive wear of the platen roller 69. If slipping occurs between a roller and the continuous medium 24, then the continuous medium 24 is not registered, i.e., labels 30 of the continuous medium 24 are not going to arrive at the print station 14 at the appropriate time. The processor 78 may attempt to prevent slipping by, among other things, varying the pressure between the platen roller 69 and the print head 67, varying the tension in the ribbon 72, and/or varying the tension in the continuous medium 24. In the event that slipping does occur, the processor 78 may correct for the slippage and re-establish registration by, among others, one or more of the following: varying the step size of the platen roller 69; varying the rate at which the platen roller 69 rotates or steps; varying the direction of rotation of the platen roller 69; varying the tension in the ribbon 72; varying the pressure between the platen roller 69 and the print head 67; varying the rate at which the medium take-up 20 winds the release liner 28; varying the rate at which the medium dispenser 18 unwinds the continuous medium 24; varying the torque about the driven spindle 21 of the medium take-up 20; varying the torque about the driven spindle 19 of the medium dispenser 18; and varying the tension in the continuous medium 24.

Among other things, the medium registration logic 86 includes logic for determining the location of the leading edges 32 and/or trailing edges 34 of the labels 30 based upon the signals from the digital signal processors 82. The medium registration logic 86 may know the positions (i.e., scan positions) at which various sensor bundles 40, 42 scan the continuous medium 24 and may know the distances between various scan positions and/or sensor bundles 40, 42, and other components and locations in the content applicator 10 such as, but not limited to, the distance between: adjacent sensor bundles 40, 42; adjacent scan positions; an edge of the label peeler 16 that peels the labels 30 from the release liner 28 and one or more of the sensor bundles 40, 42; an edge of the label peeler 16 that peels the labels 30 from the release liner 28 and one or more of the scan positions; the print head 67 and one or more of the sensor bundles 40, 42; the print head 67 and one or more of the scan positions; and an edge of the label peeler 16 that peels the labels 30 from the release liner 28 and the print head 67.

The medium registration logic 86 also includes logic for determining the rate of advancement and/or retraction, i.e., the speed of the continuous medium 24 and the direction of the continuous medium 24. In some embodiments, the medium registration logic includes logic for determining the location of a label based upon characteristics of the label. For example, the sensor array 12 may detect transitions between different regions in the label, and the position of the label may be determined based upon the transitions. Similarly, the sensor bundles 40, 42 may detect leading edges 32 and/or trailing edges 34, and the position of the label may be determined based upon the leading edges 32 and/or trailing edges 34.

In some embodiments, the medium registration logic 86 includes logic which when executed by the processor 78 may be used to generate a scan profile for the labels 30 of the continuous medium 24. The scan profiles can be used to determine the location of the labels 30 based upon the signals from the digital signal processors 82. The processor 78, while executing the medium registration logic 86 may compare the signals from the digital signal processors 82 with the scan profile to determine which portion of the scanned label 30 is currently being scanned. Such information may be used to determine the current position and/or velocity/speed of the scanned label.

Sensor calibration may be necessary when determining a transition edge such as leading edge 32 or trailing edge 34 or specific top of form (TOF) reference point such as black line 96 (FIG. 5A) for a given label 30. If the sensor bundles 40, 42 of the sensor array 12 are not calibrated properly, the content applicator 10 might not maintain accurate and reliable registration. Two methods, among others, may be used to calibrate the sensor bundles 40, 42 such as scan and compare data to a historical profile stored in memory or generate a learned profile. Both methods may be initiated automatically, e.g., through an automated sequence of events, or manually, e.g., by a manual operation by the user. Calibration may be repeated throughout a roll of continuous medium, and scan profiles may be modified and updated if necessary to improve registration. One or more sensor bundles 40, 42 may be used for calibration. Sensor bundles may be movable or in a permanent fixed position. Sensor bundles may be positioned before or after the print station 14. While multiple sensor bundles are not required for calibration or detecting transition areas, multiple sensor bundles do provide better resolution of tracking medium position and medium advancement rates than can be obtained with a single sensor bundle.

Each one of the sensor bundles 40, 42 provides an analog sensor signal(s), which is received by the processor 78 through one or more digital signal processors (DSPs) 82. The sensor signals may be filtered or compressed to fit a desired threshold limit. The medium registration logic 86 may include logic operations or algorithms that may be applied to a scan profile to determine the ideal transition edge. A scan may be over a distance corresponding to a single pitch within a medium, or over a distance covering multiples of this repeat length. For each scanned label 30, the scan may also be limited to only a random portion within the scanned label 30 or may also be limited to only a specific portion within the scanned label 30. The acquired scan may be compared to a known historical reference profile or profiles, which enables the processor 78 to determine which portion of the label 30 was scanned.

In some embodiments, a threshold may be calculated. The processor 78 can then ignore signals above (or below) the threshold. For example, there may be anomalies within or on a label, which produce signal anomalies, and/or variations in color, which produce variations in the signals (as in FIG. 5). Variations in signals from a sensor bundle 40, 42 may also occur when the sensor bundle scans a label with wireless communications device 68 such as an RFID antenna, or a label where opacity levels change, or when the sensor bundle scans a continuous medium 24 having multiple types of labels 30.

During automatic calibration, the medium registration logic 86 may select a duty cycle that falls in a middle range for available sensor gain. But, in some embodiments, the medium registration logic 86 may be configured to allow a user to manually adjust/input to sensor amplification in order to achieve a desired duty cycle. As one non-limiting example, automatic sensor calibration by the medium registration logic 86 may include a look-up table and multiple calibration test values. For example, two of the test values may represent lower and upper threshold comparator levels, a third value may represent gain, and a fourth value may represent current drive. These calibration test values may be automatically set on a test command. The medium registration logic 86 may then find a drive/gain combination in the look-up table for a minimum comparator sample and a maximum comparator sample. The minimum and maximum comparator values are selected to differ by at least a predetermined number. As another example, a first test value may represent a comparator value, which should be within a predetermined range of comparator values. If this first value is not within the predetermined range of comparator values, a second test value, which may represent gain, may be changed to another second test value, and the medium registration logic 86 selects a different first test value. Typically, both the first test value and the second test value have respective ranges of value, and if the respective values of both the first test value and the second test value are outside of their respective ranges, then there may be a sensing problem.

In some embodiments, the medium registration logic may be implemented in firmware that is stored in a memory and that is executed by a suitable instruction execution system. If implemented in hardware, as in an alternative embodiment, the medium registration can be implemented with any or a combination of the following technologies: a discrete logic circuit(s) having logic gates for implementing logic functions upon data signals, an application specific integrated circuit (ASIC) having appropriate combinational logic gates, a programmable gate array(s) (PGA), a field programmable gate array (FPGA), etc.

Figures 5A, 5B, 6:
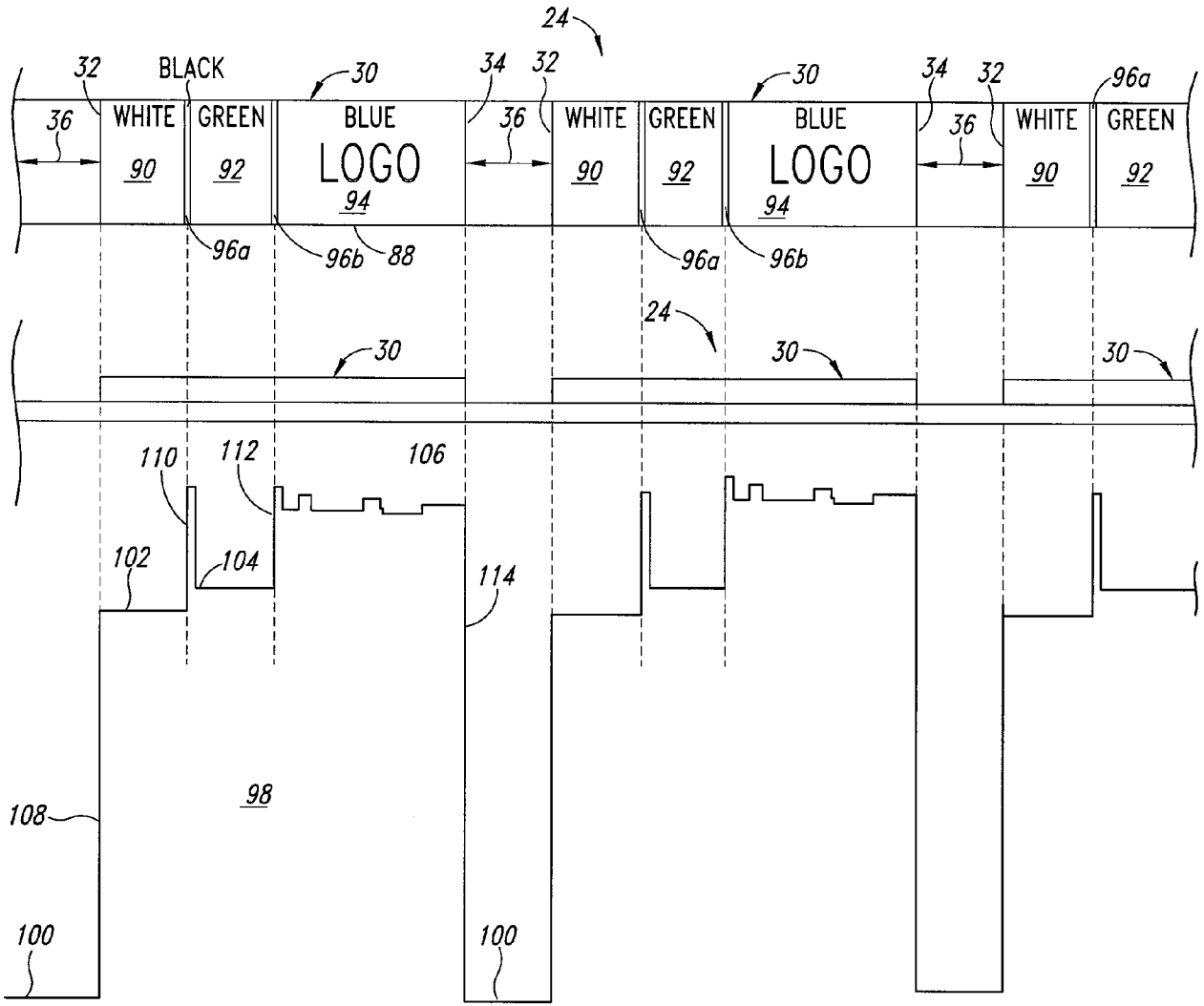
FIG. 5A is a top view of a continuous medium according to one illustrated embodiment.
FIG. 5B is a side view of the continuous medium of FIG. 5A according to one illustrated embodiment.
FIG. 6 is a scan profile of the continuous medium of FIGS. 5A and 5B according to one illustrated embodiment.

FIG. 5A shows the top face 31 of the continuous medium 24, and FIG. 5B shows a face 88 of the continuous medium 24 according to one illustrated embodiment. The continuous medium 24 includes a number of labels 30 that are substantially identical and generally equally separated by a gap 36. Each one of the labels 30 includes a white region 90, a green region 92, and a blue region 94. A first black stripe 96*a* interposes the white region 90 and the green region 92, and a second black strip 96*b* interposes the green region 92 and the blue region 94.

FIG. 6 shows a number of scan profiles 98 according to one illustrated embodiment. The scan profile 98 has a number of relatively flat regions 100, 102, 104, and 106, and a number of steps 108, 110, 112, and 114. The generally flat region 100 is a minima that corresponds to the gap region 36. The step 108 corresponds to the leading edge 32 and the generally flat region 102 corresponds to the white region 90. The step 110 corresponds to the first black strip 96*a*, and the generally flat region 104 corresponds to the green region 92. The step 112 corresponds to the second black strip 96*b*, and the generally flat region 106 corresponds to the generally blue region 94. In addition, the step 114 corresponds to the trailing edge 34.

Figures 7A, 7B, 8:
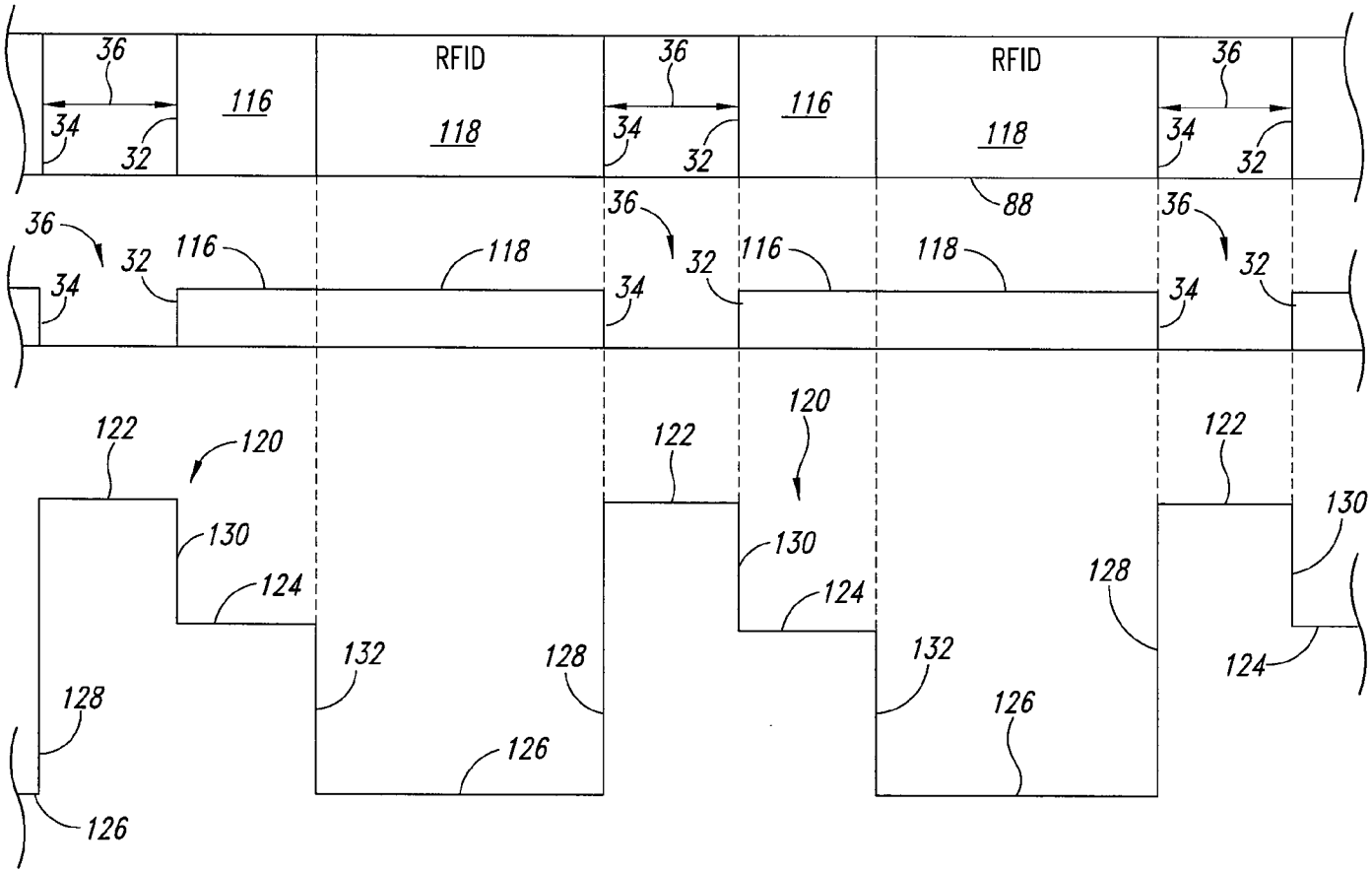
FIG. 7A is a top view of a continuous medium having a wireless communication device according to one illustrated embodiment.
FIG. 7B is a side view of the continuous medium of FIG. 7A according to one illustrated embodiment.
FIG. 8 is a scan profile of the continuous medium of FIGS. 7A and 7B according to one illustrated embodiment.

FIGS. 7A and 7B show a portion of the continuous medium 24 according to another illustrated embodiment as seen from above and along a face 88, respectively. The continuous medium 24 includes a number of labels 30 that are substantially identical and generally equally separated by a gap 36. Each one of the labels 30 includes a first region 116 and an RFID region 118. In this embodiment, the color of the first region 116 and the RFID region 118 are the same. The RFID region 118 includes components and circuitry of an RFID device (not shown).

FIG. 8 shows a sequence of scan profiles 120, which correspond to the portion of the continuous medium 24 of FIGS. 7A and 7B. In this example, the scan profiles 120 correspond to the output of one of the opposed sensor bundles 40. The scan profiles 120 include a number of generally flat regions 122, 124, and 126 and a number of steps 128, 130, and 132.

The generally flat region 122 corresponds to the gap region 36, and the step 130 corresponds to the leading edge 32. The generally flat region 124 corresponds to the first region 116, and the generally flat region 126 corresponds to the RFID region 118. The step 124 corresponds to the transition between the first region 116 and the RFID region 118. The step 128 corresponds to the trailing edge 34. The output of the opposed sensor bundle 40 is greatest in the gap region 36 where the continuous medium 24 is the thinnest, i.e., where the continuous medium 24 consists of the release liner 28. The output of the opposed sensor bundle 40 drops when the first region 116 is scanned. Less of the incident electromagnetic radiation 48 is transmitted through the release liner 28 and the region 116 of the label 30 than through the relatively thin release liner 28 in the gap region 36. Similarly, when the RFID region is scanned, the components and circuitry of the RFID device interfere with the electromagnetic radiation being transmitted through the RFID region 118. Consequently, the output of the opposed sensor bundle 40 drops to the generally flat region 126.

In some embodiments, a reference scan profile is stored in the memory 80, and used by the processor 78 to, among other things, determine registration of the continuous medium 24. In some embodiments, the memory 80 may include multiple reference scan profiles of the continuous medium 24. The multiple scan reference profiles stored in the memory 80 may correspond to scans by different types of scanning devices, e.g., opposed scanner bundles 40 and non-opposed scanner bundles 42, or by scans done using different types of electromagnetic sources, or by scans done using different types of electromagnetic detectors. The processor 78 may receive scan information from a particular sensor bundle and compare the scan information to a stored reference profile to determine which portion of the label is currently being scanned, and thereby, determine the relative location of the scanned label.

Figure 9:
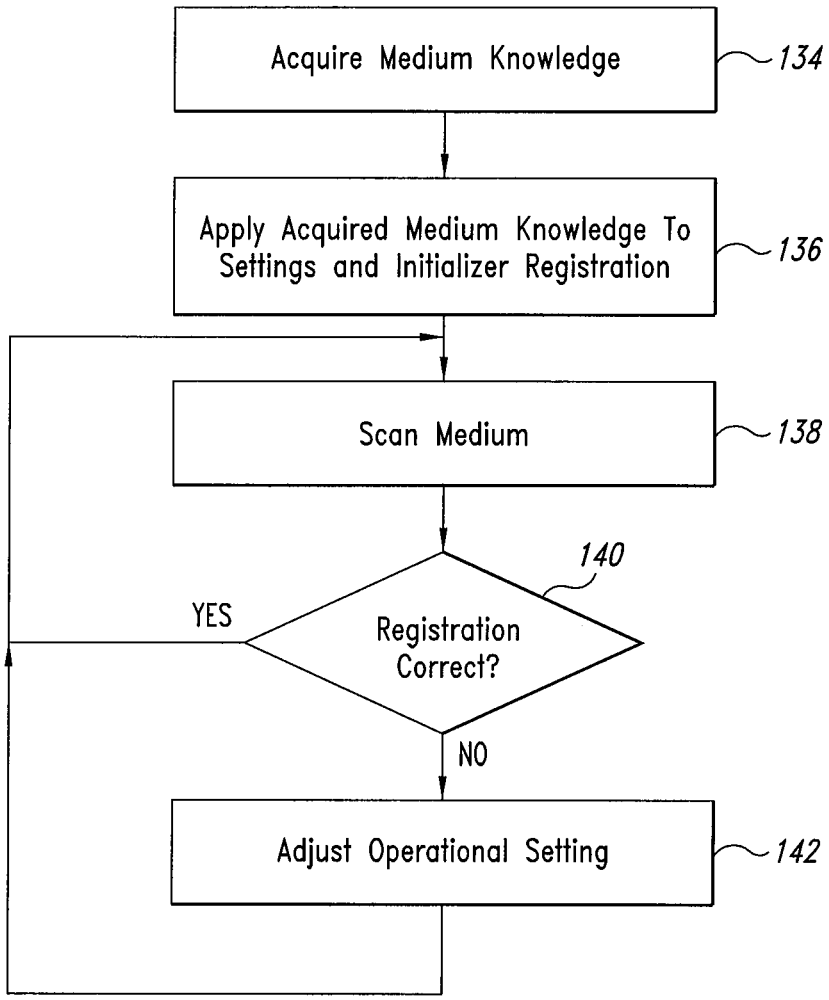
FIG. 9 is a flow diagram showing a method employed to process a continuous medium according to one embodiment.

FIG. 9 shows an exemplary method, which may be implemented by the controller subsystem 22, for registering the continuous medium 24.

At 134, medium knowledge is acquired. The acquired medium knowledge enables the controller subsystem 22 to determine the position of the labels 30 within the sensor array 12 using the acquired medium knowledge. In some embodiments, the acquired medium knowledge may be inputted into the content applicator 10 by a user. For example, the user might input characteristics of the continuous medium 24 such as, but not limited to, gap size, label length, label color, presence or absence of RFID devices, presence or absence of holes 62, and/or presence or absence of transition indicia 64. In some embodiments, the controller subsystem 22 may acquire the medium knowledge by generating one or more scan profiles of a segment of the continuous medium 24. For example, a segment of the continuous medium 24 may be fed through the sensor array 12 and scanned. One or more scan profiles may be generated from the scanned segment, and these scan profiles become the acquired knowledge upon which reference profiles are based. In some embodiments, the controller subsystem 22 may acquire medium knowledge by interrogating one or more RFID devices carried in one or more labels 30.

At 136, the acquired knowledge is applied to settings and operational parameters of the content applicator 10 and to provide initial registration of the continuous medium 24 with the print station 14. As an example, the acquired knowledge may be used to set a desired advance rate for the continuous medium.

At 138, the continuous medium 24 is advanced (or retracted), and the portion of the continuous medium 24 within the sensor array is scanned. The continuous medium 24 is scanned by passing the continuous medium 24 along the medium transport pathway 26 of the sensor array 12. The sensor array 12 provides the controller subsystem 24 with signals corresponding to the outputs of the electromagnetic detectors 46 and 54.

At 140, the controller subsystem 22 determines whether the continuous medium 24 is properly registered. If the registration is correct, the process returns to 138. On the other hand, if the registration of the continuous medium is incorrect, the process continues at 142. At 142, the controller subsystem 22 determines an adjustment to one or more of the operational settings or parameters.

At 142, the adjustment is implemented by the controller subsystem 22. Adjustments include, but are not limited to, varying the pressure between the platen roller and the print head, varying the tension in the continuous medium, varying the tension in the ribbon, varying the step size of the platen roller, and/or varying the velocity of the continuous medium through the content applicator 10.

Figure 10:
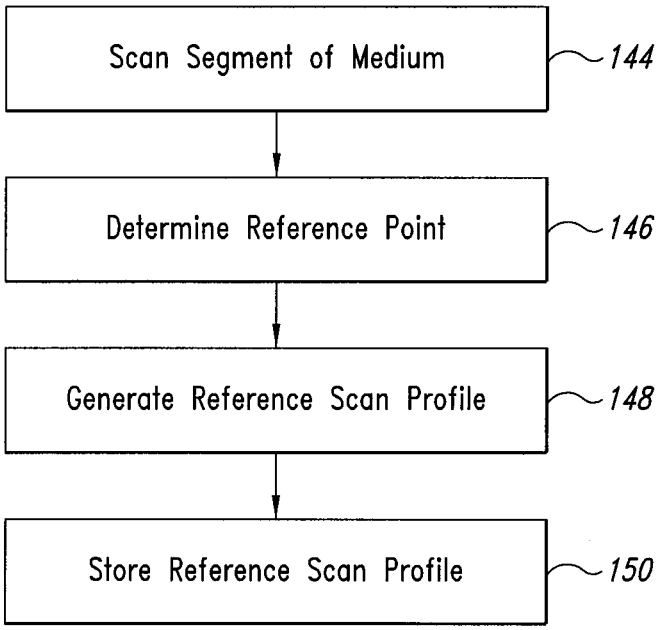
FIG. 10 is a flow diagram showing a method employed to acquire a reference scan profile according to one embodiment.

FIG. 10 shows a method of acquiring medium knowledge according to one illustrated embodiment. At 144, a length of continuous medium is scanned by the sensor array 12. During the scan, the sensor array 12 provides the controller subsystem 22 with the outputs of the sensor bundles 40, 42.

At 146, the controller subsystem 22 determines a reference point. Among other things, the reference point may be the location of a gap 36, the location of a hole 62, the location of transition indicia, and/or the location of the gap 36, as determined by change in height of the label or change in intensity or frequency of electromagnetic radiation.

At 148, the controller subsystem 22 generates a reference scan profile from the signals provided by the sensor array 12. Typically, the sensor array or the length of the scan is such that more than one label 30 has been scanned. In that case, the controller subsystem 22 processes the scan information to determine where the output signals from the sensor array starts to repeat. At 150, the controller subsystem 22 stores the reference scan profile in the memory.

Figure 11:
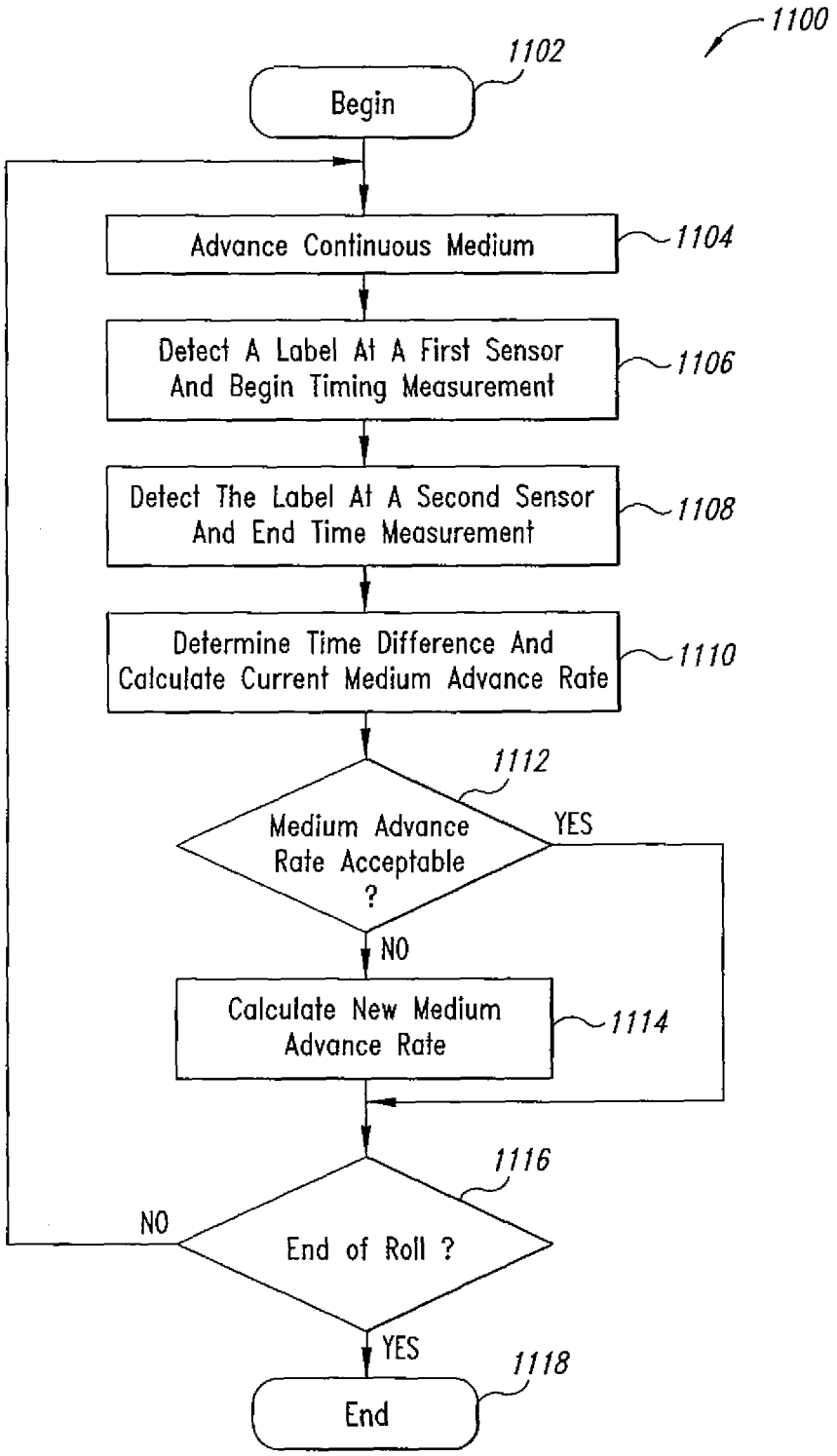
FIG. 11 is a flow diagram showing a method employed to process a continuous medium according to one embodiment.

FIG. 11 shows a method 1100 of controlling registration of the continuous medium 24 according to one illustrated embodiment. The process 1100 allows the controller subsystem 22 to constantly monitor the rate at which the continuous medium 24 advances (or retracts) through the content applicator 10 and proper registration may be maintained by adjusting the rate at which continuous medium 24 advances (or retracts).

At 1102, the process begins. The continuous medium 24 is feed through the content applicator 10 along the medium transport pathway 26 from the medium dispenser 18 to the medium take-up 20.

At 1104, the continuous medium 24 is advanced along the medium transport pathway 26. The continuous medium 24 may be advanced (or retracted) in discrete steps, which may be of equal step size or variable step size, and the time between the discrete steps may be periodic or variable. In some embodiments, the time interval between discrete steps may be so small such that the advancement (or retraction) of the continuous medium 24 may be effectively continuous. Similarly, in some embodiments, the advancement (or retraction) of the continuous medium 24 may be continuous.

At 1106, a first one of the sensor bundles such as sensor bundle 42*b* detects a label 30. The sensor bundle 42*b* may detect the leading edge 32 or trailing edge 34 of the label 30 or may detect a transition in the label 30. When the sensor bundle 42*b* detects a specific portion of the label 30 such as the leading edge 32 or trailing edge 34, a timing measurement begins. The controller subsystem 22 may start a clock or may record the current time of a clock.

At 1108, a second one of the sensor bundles such as sensor bundle 40*b* detects the same label 30. The sensor bundle 40*b* may detect the leading edge 32 or trailing edge 34 of the label 30 or may detect a transition in the label 30. When the sensor bundle 40*b* detects the same specific portion of the same label 30, the timing measurement ends. The controller subsystem 22 may stop the clock or may record the current time of the clock.

At 1110, the controller subsystem 22 determines the time difference between when the first and second sensor bundles detected the same label. Based upon the time difference and the distance between the first and second sensor bundles, the controller subsystem 22 determines calculates a current medium advancement rate for the continuous medium 24.

At 1112, the controller subsystem 22 determines whether the current medium advancement rate is acceptable. If the current medium advancement rate is not within a certain tolerance of a desired medium advancement rate, then the current medium advancement rate is unacceptable because registration of the continuous medium 24 with respect to the print head 67 and/or the label peeler 16 will be lost.

If the current medium advancement rate is not acceptable, the process continues at 1114. Otherwise, the process continues at 1116. At 1114, the controller subsystem 22 determines a new medium advancement rate. The new medium advancement rate may speed up, slow down, and/or reverse the direction of movement of the continuous medium 24, e.g., retract the continuous medium 24.

At 1116, the controller subsystem 22 determines whether the end of the continuous medium 24 has been reached. If the end of the continuous medium 24 has been reached, the process ends at 1118. Otherwise, the process returns to 1104, where the medium advancement rate is used to advance the continuous medium.

Figure 12:
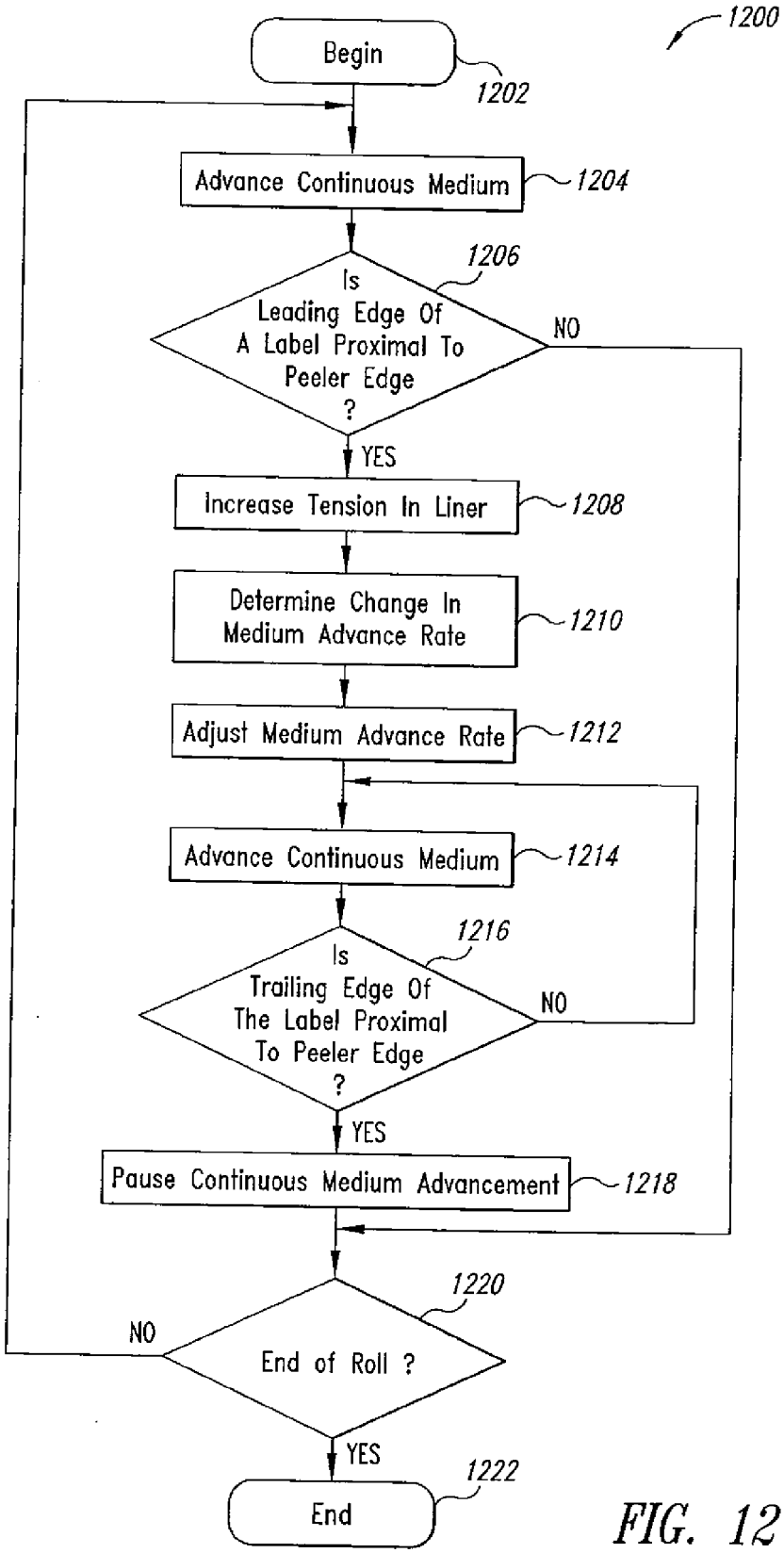
FIG. 12 is a flow diagram showing a method employed to process a continuous medium according to one embodiment.

FIG. 12 shows a method 1200 of controlling registration of the continuous medium 24 according to one illustrated embodiment. The process 1200 allows the controller subsystem 22 to constantly monitor rate at which the continuous medium 24 advances (or retracts) through the content applicator 10. The controller subsystem 22 may control variations in the rate at which the continuous medium 24 advances (or retracts) with a high degree of resolution such that one or more adjustments may be made before a label traverses the distance of a label length.

At 1202, the process begins. The continuous medium 24 is feed through the content applicator 10 along the medium transport pathway 26 from the medium dispenser 18 to the medium take-up 20.

At 1204, the continuous medium 24 is advanced along the medium transport pathway 26. The continuous medium 24 may be advanced (or retracted) in discrete steps, which may be of equal step size or variable step size, and the time between the discrete steps may be periodic or variable. In some embodiments, the time interval between discrete steps may be so small such that the advancement (or retraction) of the continuous medium 24 may be effectively continuous. Similarly, in some embodiments, the advancement (or retraction) of the continuous medium 24 may be continuous.

At 1206, the controller subsystem 22 determines whether a leading edge 32 of a label 30 is proximal to an edge (or bar 17) of the label peeler 16 where the label is peeled from the release liner. In some embodiments, the label peeler 16 may include a sensor bundle 40 or 42 that detect labels in proximity to the edge where the labels 30 are peeled from the release liner 29. In other embodiments, the controller subsystem 22 may calculate that the leading edge 32 of a label 30 is in proximity to the edge (or bar 17) where the labels 30 are peeled from the release liner 29. For example, controller subsystem 22 may know the distance between a scan point by one of the sensor bundles 40, 42 and the edge (or bar 17) where the labels 30 are peeled from the release liner 29, and the controller subsystem 22 may calculate the distance traveled by a label after the label or a portion of the label passes through the scan point. If the leading edge is not proximal to the edge where the labels 30 are peeled from the release liner 29, the process continues at 1220, otherwise, the process continues at 1208.

At 1208, the controller subsystem 22 increases the tension in the release liner 29. The spindle 21 of the medium take-up 20 may be driven with a DC motor though a transmission of a fixed drive ratio. The controller subsystem 22 controls the spindle 21 to wind up the release liner 29 and apply a tension on the release liner 29. The increased tension in the release liner 29 facilitates peeling the label from the release liner and also facilitates pulling the continuous medium 24 through the print station 14.

At 1210, the controller subsystem 22 determines a change in medium advancement rate caused by the increased tension in the release liner. There is a desired or theoretical rate at which the continuous medium 24 should advance through the medium transport pathway 26. Pulling the continuous medium 24 through the print station 14 by increasing the tension in the release liner 29 changes the rate at which the medium advances through the medium transport pathway 26. The controller subsystem 22 may determine the change in the medium advancement rate based upon information from the sensor array 12.

At 1212, the controller subsystem 22 adjusts the medium advancement rate to compensate for the pulling of the release liner 29 by the spindle 21. Typically, the controller subsystem 22 may decrease the medium advancement rate. If the continuous medium 24 is being discretely stepped through the medium transport pathway 26, the controller subsystem 22 may decrease the step size or increase the time interval between steps. If the continuous medium 24 is being continuously moved through the medium transport pathway 26, the controller subsystem 22 decreases the rate, i.e., change the speed at which the continuous medium moves.

At 1214, the continuous medium 24 is advanced.

At 1216, the controller subsystem 22 determines whether the trailing edge of the label is in proximity to the edge (or bar 17) where the label is peeled from the release liner. In some embodiments, the label peeler 16 may include a sensor bundle 40 or 42 that detect labels in proximity to the edge (or bar 17) where the labels 30 are peeled from the release liner 29. In other embodiments, the controller subsystem 22 may calculate that the trailing edge 34 of a label 30 is in proximity to the edge (or bar 17) where the labels 30 are peeled from the release liner 29. For example, controller subsystem 22 may know the distance between a scan point by one of the sensor bundles 40, 42 and the edge (or bar 17) where the labels 30 are peeled from the release liner 29, and the controller subsystem 22 may calculate the distance traveled by a label after the label or a portion of the label passes through the scan point. If the trailing edge is not proximal to the edge where the labels 30 are peeled from the release liner 29, the process continues at 1214, otherwise, the process continues at 1218. Typically, 1214 is repeated until the leading edge 32 of the label 30 is beyond the edge (or bar 17) where the labels 30 are peeled from the release liner 29 and only a small portion of the label 30 remains attached to the release liner 29.

At 1218, the advancement of the continuous medium 24 is paused until the label that has been partially peeled from the release liner is taken away. Typically, a label applicator (not shown) takes the label from the release liner and applies the label to an object (not shown).

At 1220, the controller subsystem 22 determines whether the end of the continuous medium 24 has been reached. If the end of the continuous medium 24 has been reached, the process ends at 1222. Otherwise, the process returns to 1204.

The above description of illustrated embodiments, including what is described in the Abstract, is not intended to be exhaustive or to limit the embodiments to the precise forms disclosed. Although specific embodiments of and examples are described herein for illustrative purposes, various equivalent modifications can be made without departing from the spirit and scope of the disclosure, as will be recognized by those skilled in the relevant art.

For instance, the foregoing detailed description has set forth various embodiments of the devices and/or processes via the use of block diagrams, schematics, and examples. Insofar as such block diagrams, schematics, and examples contain one or more functions and/or operations, it will be understood by those skilled in the art that each function and/or operation within such block diagrams, flowcharts, or examples can be implemented, individually and/or collectively, by a wide range of hardware, software, firmware, or virtually any combination thereof. In one embodiment, the present subject matter may be implemented via Application Specific Integrated Circuits (ASICs). However, those skilled in the art will recognize that the embodiments disclosed herein, in whole or in part, can be equivalently implemented in standard integrated circuits, as one or more computer programs running on one or more computers (e.g., as one or more programs running on one or more computer systems), as one or more programs running on one or more controllers (e.g., microcontrollers) as one or more programs running on one or more processors (e.g., microprocessors), as firmware, or as virtually any combination thereof, and that designing the circuitry and/or writing the code for the software and/or firmware would be well within the skill of one of ordinary skill in the art in light of this disclosure.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A method of controlling a content applicator, the method comprising:

scanning a continuous medium received by the content applicator, the continuous medium including a number of labels, to detect a height of the continuous medium, a presence of a wireless communication device carried by the continuous medium, and at least one of a leading edge or a trailing edge of at least one of the labels;

receiving a number of sets of scan information resulting from the scanning of the continuous medium;

determining a scan location by comparing at least one of the sets of scan information to a reference scan profile; and changing a rate at which the continuous medium moves through a print station of the content applicator based upon the determined scan location.

2. The method of claim 1, further comprising:

determining settings for the content applicator based upon at least one of the sets of scan information; and establishing initial registration of the continuous medium with a print head based upon at least one of the sets of scan information.

3. The method of claim 2 wherein scanning a continuous medium includes:

scanning a length of the continuous medium, the scanned length including at least one label; and generating a profile from the scanned length of the continuous medium for comparison to the reference profile.

4. The method of claim 2 wherein scanning a continuous medium includes:

interrogating a wireless communication device carried by the continuous medium; and receiving a wireless response from the wireless communication device.

5. The method of claim 1 wherein changing the rate includes:

varying a rate of rotation of a roller.

6. The method of claim 5 wherein varying the rate of rotation includes:

varying a step size of the roller.

7. The method of claim 5 wherein varying the rate of rotation includes:

varying a time between which the roller steps.

8. The method of claim 1, further comprising:

applying a variable tension to the continuous medium.

9. The method of claim 8 wherein applying a variable tension to the continuous medium comprises:

adjusting a rate at which a spindle having a roll of continuous medium thereon rotates.

10. The method of claim 1 wherein changing the rate includes:

determining a rate of advancement and retraction of the continuous medium.

* * * * *